United States Patent [19]

Bodnar

[11] 4,074,495

[45] Feb. 21, 1978

[54] SHEET METAL PANEL

[76] Inventor: Ernest Robert Bodnar, 29 Blackdown Crescent, Islington, Toronto, Ontario, Canada

[21] Appl. No.: 717,658

[22] Filed: Aug. 25, 1976

Related U.S. Application Data

[63] Continuation-in-part of Ser. No. 580,709, May 27, 1975, Pat. No. 4,027,517, which is a continuation-in-part of Ser. No. 431,098, Jan. 7, 1974, abandoned, which is a continuation-in-part of Ser. No. 311,703, Dec. 7, 1972, abandoned.

[51] Int. Cl.[2] ..... E04C 2/32

[52] U.S. Cl. ..... 52/613; 52/630; 428/603

[58] Field of Search ..... 29/193, 193.5; 52/528, 52/545, 570, 618, 625, 630, 537, 613; 428/582, 583, 584, 603; 68/226, 228, 233, 229, 223; 99/448, 425

[56] References Cited

U.S. PATENT DOCUMENTS

| | | | |
|---|---|---|---|
| 383,759 | 5/1888 | Orr et al. | 52/537 |
| 1,056,072 | 3/1913 | Vogan | 52/630 |
| 2,120,157 | 6/1938 | Sowney | 68/233 |
| 2,732,700 | 1/1956 | Dunn | 68/233 |
| 3,059,733 | 10/1962 | Hermann | 52/537 |
| 3,111,788 | 11/1963 | Ouellet | 52/537 |
| 3,376,120 | 4/1968 | Hiegel | 29/193 |
| 3,608,267 | 9/1971 | Curran | 52/588 |
| 3,902,288 | 9/1975 | Knudson | 52/588 |
| 3,982,373 | 9/1976 | Wilson et al. | 52/528 |

FOREIGN PATENT DOCUMENTS

| | | | |
|---|---|---|---|
| 24,603 | 4/1951 | Finland | 68/233 |
| 11,495 | 12/1904 | United Kingdom | 99/425 |

*Primary Examiner*—L. Dewayne Rutledge
*Assistant Examiner*—Michael L. Lewis

[57] ABSTRACT

This specification discloses strip sheet metal panels formed with transverse indentations and longitudinal formations formed therein, with end portions at each end of said panels being free of said transverse indentations.

2 Claims, 4 Drawing Figures

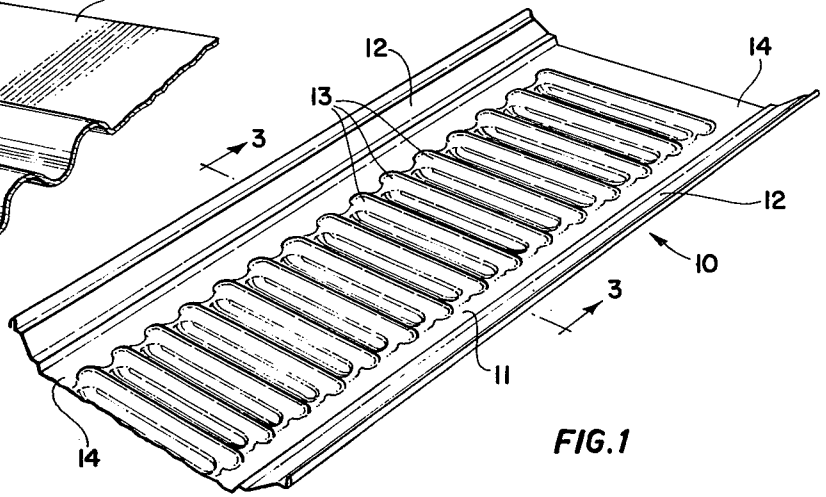
FIG.1
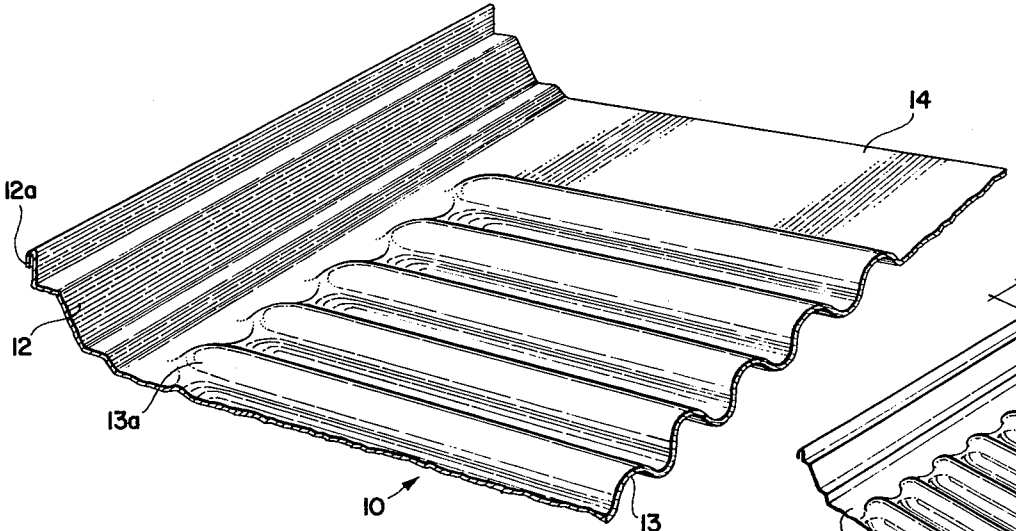
FIG.2
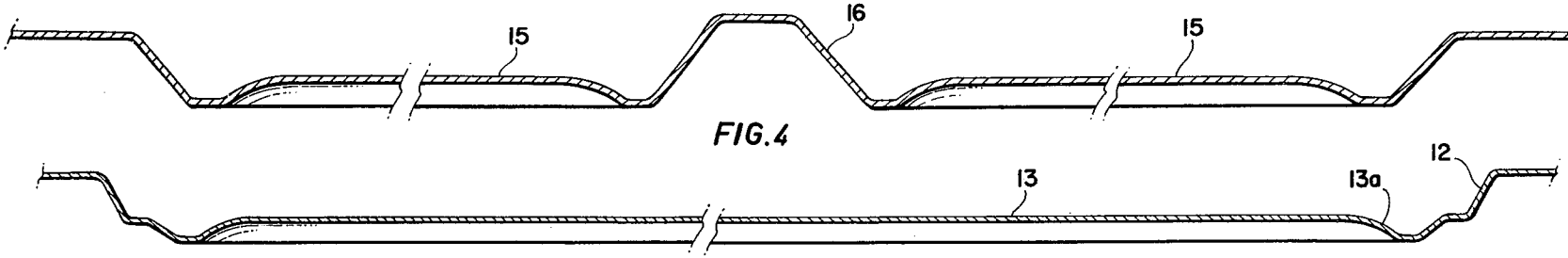
FIG.3
FIG.4

SHEET METAL PANEL

This application is a Continuation-in-Part of Ser. No. 580,709, filed May 27, 1975, now U.S. Pat. No. 4,027,517, which is a Continuation-in-Part of Ser. No. 431,098, filed Jan. 7, 1974, now abandoned, which is a Continuation-in-Part of Ser. No. 311,713, filed Dec. 7, 1972, now abandoned.

The present invention relates to an embossed sheet metal strip panel having transverse indentations across a part of the strip, and end portions free of such indentations.

BACKGROUND OF THE INVENTION:

In the art of roll forming sheet metal, it has for many years been considered desirable to emboss transverse indentations across a strip passing along a sheet metal rolling line, or across a part of the strip, so as to provide increased strength, or to provide for a specific function in an end product. The provision of transverse indentations, coupled with the formation of longitudinal indentations or formations, in a sheet metal strip, greatly increases the rigidity of the strip, and such increase in rigidity leads to various economies, principally due to the fact that a lighter gauge of metal may be used for specific applications than was hitherto possible. For example, in the manufacture of roof decking, sheet metal having a combination of transverse indentations and longitudinal indentations is found to have much greater rigidity and thereby permits the use of lighter gauge steel, thereby making the roof decking somewhat cheaper. In addition, the use of lighter weight material permits the use of somewhat lighter gauge beams in the roof, and other supports in the building structure which thereby permits considerable savings in construction costs over conventional materials.

However, notwithstanding the desirability of such products, progress in the development of manufacturing techniques for such products in the past has been disappointing. Various proposals have been put forward for manufacturing these types of products.

For example, U.S. Pat. No. 3,137,922 shows a method of manufacturing such a product incorporating transverse indentations in the form of an elongated diamond. In this process, the sheet metal strip was first of all passed through a series of roll forming dies or so called "stands" to form longitudingal channel like formations along either edge of the strip, after which the strip was passed through a group of cold working rolls, to flex and extend a portion of the central web of the strip, and then the strip was passed through one pair of embossing rolls. In practice, however, this process was found to produce uneven indentations, with irregular folds or ridges in the metal which did not conform accurately to the shape of the embossing rolls. As a result, the line was difficult to run, and the end product was possessed of uneven and unpredictable stress properties such that it could not in practice be relied upon with any accuracy.

U.S. Pat. No. 3,394,573, granted to E. R. Bodnar, shows a process of embossing transverse indentations without any previous cold working step. Again, while this line was found to be satisfactory for producing relatively simple sections, where both the transverse and the longitudinal indentations were more or less the same depth, it was not found to be entirely satisfactory for producing more complex formations. In addition, while the foregoing proposals describe systems capable of producing a metal strip with continuous deformations formed therein, they were not capable of producing intermittent lengths of such material with indentations formed in some parts, and not in others, and accordingly the usefulness of the earlier systems was somewhat restricted.

BRIEF SUMMARY OF THE INVENTION

The invention therefore seeks to provide a roll formed sheet metal panel formed of strip sheet metal cut to a predetermined length, said panel comprising, a central portion, and two side portions, continuous roll formed longitudinal fold formations extending continuously along both side portions of said panel running from one end to the other thereof without interruption, a plurality of identical transverse indentations formed in the central portion of said panel, extending from side to side thereof between said longitudinal fold formations, and terminating just short of said longitudinal fold formations, and, flat planar central portions of said panel at each end thereof extending from side to side of said central portion wherein said transverse indentations are absent, and being flanked by said longitudinal fold formations on either side thereof.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

FIG. 1 is a perspective illustration of a panel of embossed sheet metal according to the invention;

FIG. 2 is an enlarged partially cut away perspective illustration of a panel of sheet metal as shown in FIG. 1 showing the transverse indentations;

FIG. 3 is a sectional elevational view of the length of sheet metal shown in FIG. 2, along the line 3—3, and, FIG. 4 is a sectional view corresponding to the section of FIG. 3 showing an alternate embodiment.

DETAILED DESCRIPTION OF A SPECIFIC EMBODIMENT

Referring now to FIGS. 1, 2 and 3 it will be seen that an embossed sheet metal panel according to the invention is shown generally as 10, and comprises an intermediate portion 11, and two side or marginal portions 12. The side or marginal portions 12 are shown with continuous lengthwise roll formed grooves or indentations, described in more detail in FIG. 2, and the intermediate portion 11 is formed with transverse indentations shown as 13. At each end of the intermediate portion 11 a flat junction portion 14 is provided, which is free of the transverse indentations 13.

As shown in more detail in FIG. 2, the transverse indentations 13 will be seen to be of a generally sine wave characteristic, and having rounded end portions 13*a*. The side or marginal portions 12 are formed with any suitable form of longitudinal indentational fold and may and preferably will incorporate some form of interlocking fold or tongue 12*a*, by means of which the panel 10 may be arranged side by side in interlocking formation to provide a continuous roof deck on a building for example. However, the invention is not to be taken as limited to roof decking panels as such, but is of course, of general application.

An alternate embodiment is shown in FIG. 4, and in this case it will be seen that the panel may be provided with two separate transverse indentations 15. In this case, however, the two transverse indentations 15, are discontinuous and are separated in the centre of the panel by a continuous longitudinal ridge 16.

The shaping of the transverse indentations in the panel will be seen of generally sinusoidal shape, with the lowest portions of the indentations lying in a common plane with the plane containing the planar end portions. The indentations thus extend only to one side, ie. upwardly relative to such plane.

Panels of this type are found to have greatly increased strength and stress resistant characteristics, enabling if necessary the use of a lighter gauge material, or alternatively providing much greater strength with an equivalent grade of material as compared with the panels previously in use.

Panels according to the invention are preferably manufactured by a continuous strip sheet metal forming line incorporating transverse embossing means and lengthwise roll forming means, and shear means, each of which performs their respective operation on the continuous sheet metal strip as the same passes along the line, the end product being the series of panels severed from the continuous strip by the shear.

One form of such line is shown in co-pending U.S. patent application Ser. No. 580,709, filed May 27, 1975, entitled METHOD AND APPARATUS FOR EMBOSSING SHEET METAL STRIP AND SHEET METAL PANEL.

The invention thus described will be seen to provide, a roll formed sheet metal panel formed of strip sheet metal cut to a predetermined length, said panel comprising, continuous roll formed longitudinal formations along either side of said panel running from one end to the other, a plurality of identical transverse indentations formed in the central portion of said panel, extending from side to side thereof between said longitudinal formations, and, flat planar portions of said panel at each end thereof extending from side to side of said central portion between said longitudinal formations.

The foregoing is a description of a preferred embodiment of the invention which is given here by way of example only. The invention is not to be taken as limited to any of the specific features as described but comprehends all such variations thereof as come within the scope of the appended claims.

What is claimed is:

1. A roll formed sheet metal panel formed of strip sheet metal cut to a predetermined length, said panel comprising;

a central portion and two side portions;

continuous roll formed longitudinal fold formations extending continuously along both side portions of said panel running from one end to the other thereof without interruption;

a plurality of identical transverse ridges and indentations of continuous sinusoidal shape in elevation formed in the central portion of said panel, along a length less than the length of said panel, and extending from side to side of said central portion between said longitudinal fold formations, and terminating just short of said longitudinal fold formations;

flat planar junction portions of said central portion at each end of said panel extending from side to side of said central portion between said longitudinal fold formations wherein said transverse ridges and indentations are absent, and being flanked by said longitudinal fold formations on either side thereof, said transverse ridges and indentations having upper and lower extremities, the lower extremities of said indentations lying in a common plane with a plane containing said planar junction portions, and said indentations extending to one side only of said plane, and exhibiting compound concave and convex curved contours characterized by an absence of flat sections and sharp angles, and complementary continuous lengthwise mating formations formed in said longitudinal fold formations, whereby said panels may be interlocked in edge to edge relation to form a structure.

2. A roll formed panel as claimed in claim 1 wherein one of said side portions is a median strip of a larger panel, and including a second said central portion extending along the edge of said median strip remote from the first said central portion and a further said side portion on the opposite edge of said second central portion, said second central portion having transverse indentations and flat planar end portions as aforesaid.

* * * * *